United States Patent [19]

Hamm

[11] 4,326,678

[45] Apr. 27, 1982

[54] TOILET TISSUE HOLDER

[76] Inventor: Earl L. Hamm, 2570 Crestdale Cir., Atlanta, Ga. 30316

[21] Appl. No.: 131,864

[22] Filed: Mar. 19, 1980

[51] Int. Cl.[3] ..... B65H 19/00

[52] U.S. Cl. ..... 242/55.2

[58] Field of Search ..... 403/206, 209, 213; 242/55.2, 55.3, 55.42, 55.53, 55.54

[56] References Cited

U.S. PATENT DOCUMENTS

| | | | |
|---|---|---|---|
| 2,372,949 | 4/1945 | Hill | 242/55.2 |
| 2,603,426 | 7/1952 | Hackney | 242/55.2 |
| 2,658,690 | 11/1953 | Hill | 242/55.2 |
| 3,155,333 | 11/1964 | Jend | 242/55.2 |
| 3,249,313 | 5/1966 | Hackney | 242/55.2 |
| 3,454,236 | 7/1969 | Shaver | 242/55.2 |
| 3,794,253 | 2/1974 | Megdall | 242/55.2 |
| 4,022,393 | 5/1977 | Curcio | 242/55.2 |
| 4,105,168 | 8/1978 | Rutherford | 242/55.2 |
| 4,222,532 | 9/1980 | DeLuca | 242/55.2 |

*Primary Examiner*—Edward J. McCarthy

[57] ABSTRACT

A roll paper holder having two L-shaped brackets spaced apart and fixed to a wall. One bracket has a rigid arm extending towards the opposite bracket and terminating in an aperture. The other bracket has a cylindrical roll paper holder fixed to the arm by a flexible cable, the opposite end of the cylindrical holder having a hook to cooperate with the aperture. The cylindrical holder can be moved up, bending the flexible cable, so a roll of paper can be placed over the cylindrical holder; then, the cylindrical holder can be moved down to cause the hook to snap into the aperture. The hook and aperture are accessible at the side of a roll of paper on the cylindrical holder.

1 Claim, 4 Drawing Figures

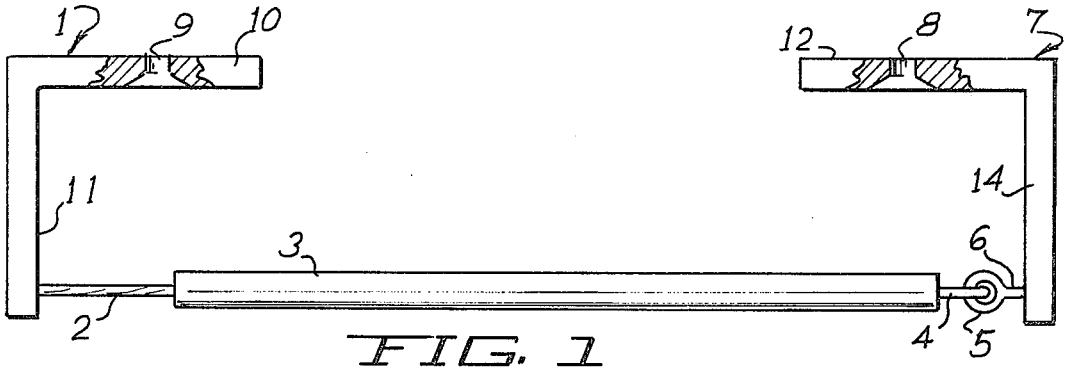
FIG. 1
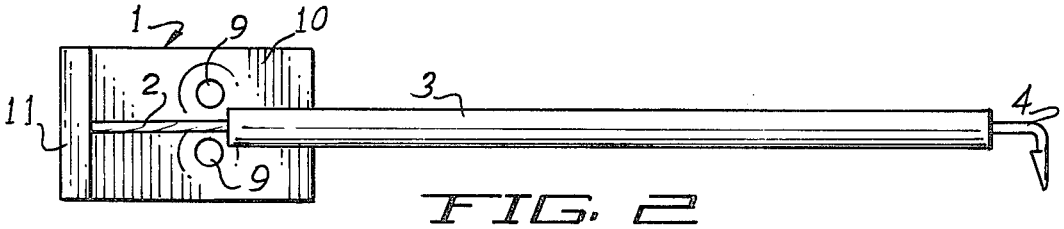
FIG. 2
FIG. 3
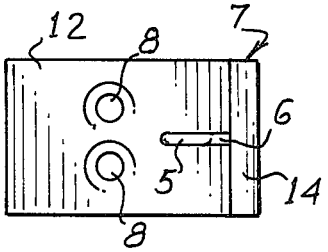
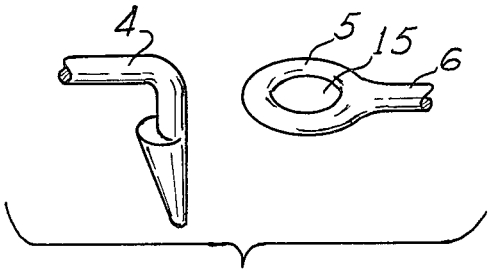
FIG. 4

TOILET TISSUE HOLDER

FIELD OF THE INVENTION

This invention relates generally to dispensing holders for roll paper and the like, and is more particularly concerned with a very simple and easy to operate holder for roll papers and the like.

BACKGROUND OF THE INVENTION

There have been numerous forms of dispensing holders for rolls of paper such as toilet tissue, paper towels, and the like, but these prior art paper holders have usually been made quite complex because of special clamps to prevent opening of the dispenser or holder, and/or the use of numerous springs and the like. While many of the prior art paper holders may well serve some peculiar function, such holders are expensive to manufacture, and require numerous parts that subject the holder to the likelihood of breakage or malfunction.

SUMMARY OF THE INVENTION

The present invention overcomes the above mentioned and other difficulties with the prior art holders by providing a roll paper holder having a pair of spaced, L-shaped brackets fixed to a wall or similar surface. One of the L-shaped brackets has fixed thereto, and extending therefrom, a flexible member connected to a cylindrical member terminating in a hook; and, the opposite L-shaped member has a generally rigid member extending therefrom and terminating in an apertured portion. The hook member is designed to be received within the aperutre of the apertured portion. Thus, the present invention provides an extremely simple roll paper holder that has few parts, and is extremely simple to operate both for the installation of a roll of paper and for the removal of the empty spool therefrom.

BRIEF DESCRIPTION OF THE DRAWINGS

These and other features and advantages of the present invention will become apparent from consideration of the following specification when taken in conjunction with the accompanying drawings in which:

FIG. 1 is a top plan view of a roll paper holder made in accordance with the present invention, portions thereof being broken away to show the construction;

FIG. 2 is a front elevational view showing one of the brackets and the hook member of the device shown in FIG. 1;

FIG. 3 is a front elevational view of the other bracket member shown in FIG. 1 of the drawings; and FIG. 4 is an enlarged, exploded view showing the hook member and the apertured member for receipt thereof.

DESCRIPTION OF AN EMBODIMENT OF THE INVENTION

Referring now more particularly to the drawings, and to that embodiment of the invention here presented by way of illustration, it will be seen that there is an L-shaped bracket 1 and a complementary L-shaped bracket 7. Each of the brackets 1 and 7 includes mounting holes 9 and 8 respectively for attachment of the brackets to a wall or other surface.

With the leg 10 of the bracket 1 fixed to a surface by means of the mounting holes 9, the opposite leg 11 will extend outwardly from the surface. The leg 11, then, has fixed thereto and extending therefrom, a flexible member 2. The flexible member 2 extends from the leg 11 of the bracket 1 to a cylindrical member 3 so that th cylindrical member 3 is movable with respect to the leg 11 by means of the flexible member 2.

The bracket 7 has its leg 12 fixed to a surface by means of the mounting holes 8, and the other leg 14 extends from the surface parallel to the leg 11. The outer end of the leg 14 has a rigid member 6 extending therefrom towards the leg 11 of the bracket 1. It will be seen in FIG. 1 that the rigid member 6 terminates in an apertured portion 5. Here, it will also be seen that the cylindrical member 3 terminates in a hook member 4 which can be received by the aperture 15 in the apertured portion 5.

Looking now particularly at FIG. 2 of the drawings, it will be seen that the hook member 4 terminates in a generally right angular hook, preferably having a slightly enlarged portion as shown to achieve a snapping action with respect to the apertured portion 5.

FIG. 4 of the drawings shows the male hook member 4 and the apertured portion 5 in more detail. In FIG. 4 it will be easily seen that the hook member 4 can be received within the aperture 15 and the slightly enlarged end of the hook member will snap into the aperture 15 to prevent inadvertent removal, while allowing easy removal when intended.

It is contemplated that the flexible member 2 will be made of cable wire or the like, though those skilled in the art will realize that numerous flexible materials can be utilized so long as the cylindrical member 3 is movable with respect to the bracket 1 and the arm 11.

From the foregoing, the use of the device should be obvious. The cylindrical member 3 can be urged up as viewed in FIG. 2 of the drawings so that the hook member 4 will be disengaged from the apertured member 5. Because of the flexible portion 2, the cylindrical member 3 can be sufficiently displaced from the apertured member 5 that a roll of paper can be placed over the cylindrical member 3. When the roll of paper is in place, the hook member 4 will be moved towards the apertured member 5, then the enlarged portion on the hook member 4 will be snapped through the aperture 15 for firm engagement. The roll of paper is thus properly installed and is free to rotate about the cylindrical member 3. It will be understood that the dimensions will be such that the hook 4 and aperture 15 will be accessible when a roll of paper is in place in the holder.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as defined in the appended claim.

I claim:

1. A roll paper holder comprising: a first L-shaped mounting bracket, one leg of said first bracket defining a screw opening to permit attachment to a vertical supporting surface, a second L-shaped mounting bracket horizontally spaced from said first bracket, one leg of said second bracket defining a screw opening to permit attachment to said supporting surface, a rigid arm fixedly attached to the other leg of said first bracket and extending in a horizontal direction towards, but spaced from, said second bracket, said rigid arm defining an aperture at the free end thereof, a flexible member attached to the other leg of said second bracket, a cylindrical member carried at the free end of said flexible member and co-axial therewith, and a hook portion at the opposite end of said cylindrical member for locking engagement with said aperture, said hook portion being disengaged from said aperture by movement of said cylindrical member and bending of said flexible member to place a roll of paper on said cylindrical member after which said cylindrical member is moved to lock said hook portion in said aperture, said hook and aperture being spaced from said roll of paper on said cylindrical member to permit access thereto.

* * * * *